United States Patent [19]

Canfield et al.

[11] Patent Number: 4,567,079

[45] Date of Patent: Jan. 28, 1986

[54] HIGH-STRENGTH BUILT-UP ROOFING USING IMPROVED PLY SHEETS

[75] Inventors: V. Robert Canfield, Martinsville; William J. Woodring, Bound Brook; Mira C. Kubiak, North Brunswick, all of N.J.

[73] Assignee: GAF Corporation, Wayne, N.J.

[21] Appl. No.: 656,213

[22] Filed: Oct. 1, 1984

[51] Int. Cl.[4] ..... B32B 3/02; B32B 3/10; B32B 11/10

[52] U.S. Cl. ..... 428/131; 428/137; 428/143; 428/192; 428/281; 428/291; 428/489

[58] Field of Search ..... 428/141, 143, 192, 131, 428/137, 280, 281, 489, 291

[56] References Cited

U.S. PATENT DOCUMENTS 2,850,404 9/1958 Dunlap ..... 428/141
3,326,366 6/1967 Butterfield et al. ..... 428/281
3,365,322 1/1968 Hinds ..... 428/281
4,233,353 11/1980 Bondoc ..... 428/143

*Primary Examiner*—Paul J. Thibodeau
*Attorney, Agent, or Firm*—Marilyn J. Maue; Joshua J. Ward

[57] ABSTRACT

Lighter weight, high strength, built-up roofing (BUR) membranes, systems and process for obtaining same are provided herein. These BUR membranes are made by using an improved ply sheet having uniform ventability and attachment in the overall assembly and superior resistance to wind uplift. The improved structure involves a ply sheet carrying ⅛ inch diameter or larger perforations along its longitudinal border in an area comprising between 1/5 and about ½ the width of the ply sheet. The ply sheets here employed for the BUR assembly or membrane have a thickness essentially not in excess of the layer of bonding agent applied over each ply in the assembly.

12 Claims, 3 Drawing Figures

HIGH-STRENGTH BUILT-UP ROOFING USING IMPROVED PLY SHEETS

BACKGROUND OF THE INVENTION

A persistent problem concerning BUR is the inefficient venting of vapors which accumulate and are trapped below the roofing plies of a BUR system. These vapors, which may originate from trapped moisture or changes in temperature or humidity, can cause blistering and buckling, which effects may lead to failure of the membrane. Accordingly, it is desirable to provide a system of venting which allows escape of these vapors from surfaces below the roofing ply sheets.

Spot or strip mopping, which leaves venting channels at the ends of the strips, has been used; however, the application of this mopping procedure requires special techniques and skills, while at best the process is very time consuming. Heretofore, heavy perforated sheeting, having a granule impregnated lower layer has been employed as a base sheet over the roof deck to minimize this problem. Although bonded to the roof by a bonding agent which flows through the perforations, the successive strips of the base sheeting, normally overlaped two inches, are not bonded to one another. The completed roofing membrane thus has no tensile strength imparted at right angles to the direction of ply laying adjacent the base sheet layer.

Accordingly, it is an object of the present invention to overcome the above difficulties in an economical and commercially feasible manner.

DESCRIPTION OF THE INVENTION

According to this invention, there is provided an improved ply sheet for a BUR assembly which comprises a roofing ply sheet composed of organic or asbestos felt or a fiberglass felt, preferably impregnated with asphalt or other suitable impregnating material and perforated in a restricted marginal area along its longitudinal length, said area not to exceed about ½ and not less than about 1/5 the width of the ply sheet, and said perforations of a size and shape to allow ready penetration of a flowable bonding agent, e.g. perforations having a diameter between about ⅛ and about 1.5 inches, preferably between about ½ and about ¾ inch diameter are acceptable. The perforations can be optionally spaced in the marginal area according to the wind uplift requirements; although the hole diameter is generally directly proportional to the spacing, e.g. 0.5–5 inch spacing, between the holes. A 2.5–3.5 inch offset center spacing for about ⅝ diameter perforations is recommended. Although the width of the ply sheet is generally controlled by the handling capacity of a felt laying machine, which is an apparatus for mechanically unrolling and firmly depositing the ply sheet in a straight parallel path over a layer of bonding material, the ply sheet can be unrolled and laid manually while brooming the strip over the bonding layer. However, the later method requires care to avoid buckling and to achieve proper alignment of the strip. Generally the width of the sheet will vary in increments of 12 inches so that strips of 12, 24, 36 or 48 inches are most available. The roofing sheets are cut from a roll of felt impregnated and coated with asphalt or a fiberglass ply roll impregnated and coated with asphalt.

Several types of bonding agent can be employed for the roofing operation including bitumen, such as asphalts and coal tar pitch having softening points of from about 100° F. to about 500° F. The bonding material can contain from 0 to about 75 weight % mineral stabilizer, such as that derived from limestone, stone dust, sand or other fine or granulated mineral particles. At the point of application, the bonding agent is heated to a flowable condition.

To realize all of the benefits of the present invention, it is generally recommended that the thickness of the roofing plies does not exceed that of the bonding layer used to join the plies to each other. Accordingly, the roofing plies of this invention have a thickness between about 0.8 mm and about 1.5 mm, in contrast with certain plies in current use having a thickness of about 3 mm.

The roofing assembly of this invention generally comprises a roof deck composed of gypsum, metal such as steel, or wood over which insulation is affixed. Concrete is also a suitable material but is most often used without insulation. When employed, the insulation, usually in the form of a rigid board, may have a thickness of from about 0.1 inch to about 6 inches and may be composed of foams of polyurethane, polystyrene or isocyanurate, composite boards such as laminated perlite board on polyurethane foam, wood fiber, fiberglass and the like. The insulation can be affixed to the roof deck by means of mechanical fasteners or by adhesives such as bitumen. Also, a vapor retarder may be applied over the roof deck beneath the insulation, if desired. All of the above coverings comprise the deck assembly. Over this assembly, a plurality of the present ply sheets is applied in parallel overlapping arrangement and the plies are bonded together at their overlapping portions and to the deck assembly at their perforated portions by means of a bonding agent. The bonded membrane is then coated with a final asphalt coat or capped with asphalt embedded with gravel or other granular mineral material or finished with a fibered aluminum coating or other suitable weather resistant coating.

For the purposes of this invention, the term "membrane" designates a plurality of bonded ply sheets which comprise the roof assembly. Generally, the roofing membrane consists of 2–6 plies which are finished with a capping sheet, layer or coating.

Upon installation, the roofing membrane of the present invention can be directly attached to the roof deck or roof deck assembly by coating the perforated ply sheet, laid along the length of the roof to be surfaced, with the bonding agent heated to a flowable condition. More often, the initial sheet of the present improved roofing ply is laid down over one or more perforated starting strips which serve to anchor the non-perforated portion of the ply to the roof deck through the starting strip by means of a bonding adhesive applied between the starting strip and the ply. Generally, the initial starting strip is perforated over its entire surface to permit ready flow of bonding agent through its perforations and thereby uniformly attach the starting strip to the deck at points over its entire surface. One or a plurality of successive starting strips can be used, if desired, to serve this function.

When plies are bonded with the preferred bonding agent, namely asphalt, the amount applied can vary between about 15 and about 30 pounds per 100 square feet of roof area. Other bonding agents are applied in comparable amounts. The heated bonding agent flows through the perforation of the plies and thus uniformly attaches the entire membrane to the roof deck at the points of perforation in the marginal area of each ply while the unbonded areas between the perforations allows for venting of vapors which may build-up due to changes in temperature and humidity. Thus, the present arrangement provides means for avoiding blistering and buckling and the need for venting chimneys or other venting devices.

Successive overlapping strips of the present roofing plies, with interply bonding, are laid down in parallel to cover the entire roof area. The overlapped areas of each ply consist of the non-perforated portions with the perforated marginal areas extending beyond the edge of the underlying ply sheet. The phrase "non-perforated area" referred to in this disclosure is intended to define a continuous ply sheet surface or a ply sheet surface having perforations of substantially smaller diameter than $\frac{1}{8}$ inch or the perforations in the marginal area and spaced so as not to appreciably diminish the strength of the ply. Most preferably, the overlapped portions of the plies comprise 5/6 to $\frac{1}{2}$ the width of the ply, e.g. $\frac{2}{3}$ its width. Although narrower or wider overlapping can be tolerated under certain circumstances, it is cautioned that narrower perforated margins reduce ventability and increase the possibility of blistering; whereas wider perforated margins, which entail narrower overlapping, lower the tensile strength of the roofing membrane. Also, overlapping involving more than $\frac{1}{2}$ the ply sheet width results in a one ply membrane which is generally insufficient to resist weathering over extended periods.

Since the present method involves a continuous coating of bonding agent on the ply surface, difficult and time consuming strip and spot mopping steps are virtually eliminated. Specifically, spot and strip mopping results in non-uniform sheet attachment and reduced ventability in the roofing system. In contrast, the present system, with its overlapped perforated sheets, provides a uniform pattern of attachment over the entire roof surface with equally uniform venting areas between. Also, the elimination of heavy base sheets, usually carrying a granulated layer, and nonperforated plies, as required in prior installations, has lightened the entire roofing assembly. Most importantly, the present BUR assembly exhibits superior tensile strength which is due to the fact that the overlapped ply sheets incorporate the venting perforations and are bonded together with bonding agent. In prior practice, the heavier plies carrying a granulated layer were not bonded at the overlap.

Reference is now had to the accompanying drawings which illustrate certain aspects of the invention.

Figure 1:
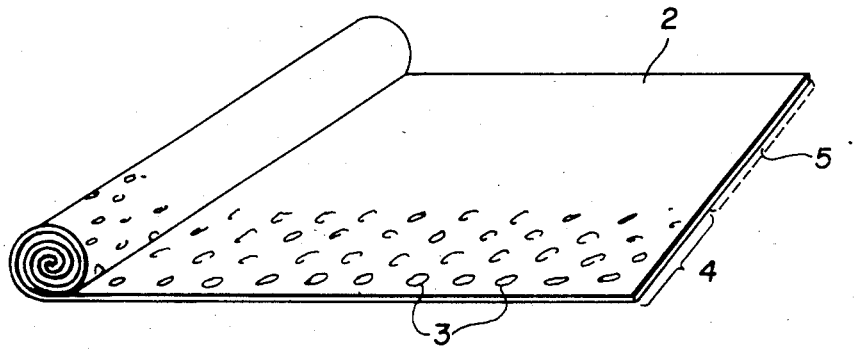
FIGS. 1 and 3 are plan views of the present improved roofing ply sheets.

In FIG. 1, roofing ply 2 carries a plurality of uniformly sized and spaces, apertures or perforations 3 along its longitudinal length in approximately a $\frac{1}{3}$ marginal area 4 of the ply sheet. Underlying sheet 2 is a bitumen layer 5 bonding ply sheet 2 to an underlying ply.

Figure 2:
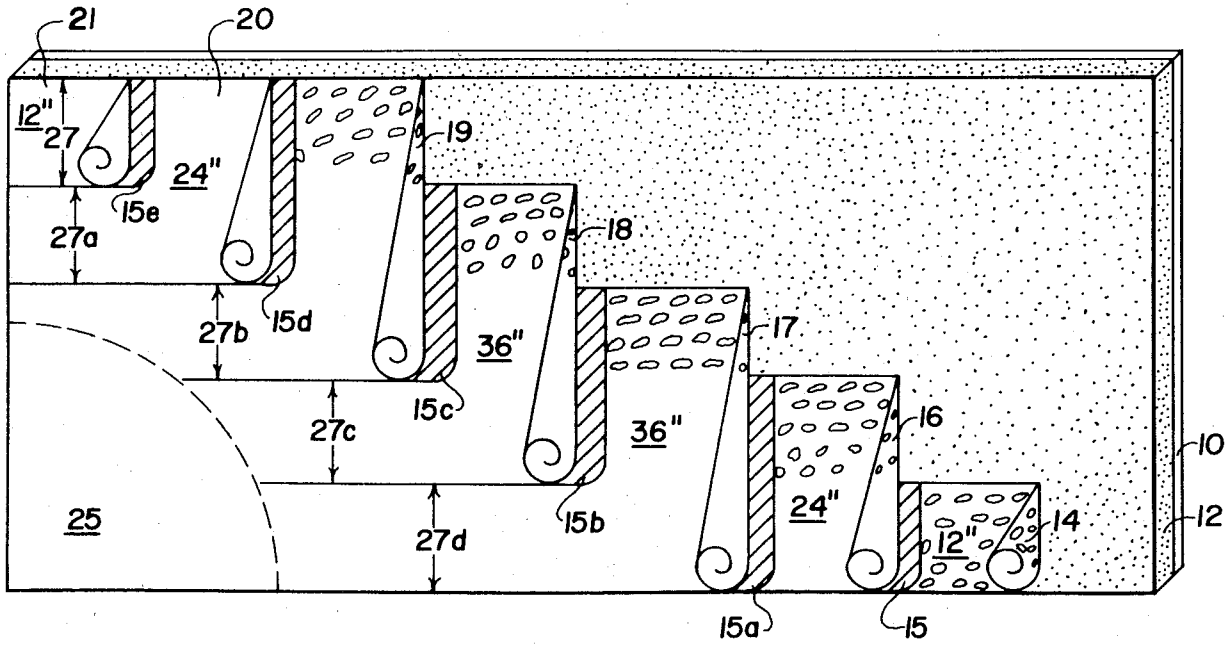
FIG. 2 is a perspective view of particular BUR assemblies. The assembly of FIG. 2 is a preferred embodiment.

According to FIG. 2, roof deck assembly 9 comprises a roof deck 10 covered with rigid foam insulation boards 12. In a typical 3-ply construction, a relatively narrow (e.g. 12 inches) and completely perforated first starter sheet 14 is rolled out along the length of the roof surface and a layer of hot bitumen or asphalt 15 is mopped over the entire perforated surface of 14 as second starter sheet 16 is brush rolled over the hot liquid bitumen coated sheet 14. Second starter sheet 16 is substantially wider than sheet 14 (here, approximately twice the width of sheet 14) and is perforated along its entire longitudinal length in a margin area comprising about $\frac{1}{2}$ its width so that when overlaying sheet 14, its non-perforated area covers and is directly bonded to underlying sheet 14 at non-perforated portions thereof and is indirectly bonded to insulation 12 through perforations in sheet 14. The perforated area of sheet 16 extends beyond the perforated edge of sheet 14 and is in direct contact with insulation 12.

Conveniently, as soon as second starter sheet 16 is completely brushed out over first starter sheet 14, hot bitumen is mopped over the width of sheet 16 as the succeeding sheet, i.e. ply sheet 17 of the present invention, is brush rolled along the length of coated sheet 16 and adhered thereto by means of hot bitumen 15*a*. Ply 17 is approximately one third wider than sheet 16 and is perforated in about a one third marginal area along the entire length of the sheet, so that, when overlaying sheet 16, about two thirds of its nonperforated width is in contact with the underlying sheet while the remaining $\frac{1}{3}$ lateral area carrying said perforations of ply 17 extends beyond sheet 16 and is in direct contact with insulation 12.

The above described interply hot bitumen mopping is repeated for as many ply membranes as it is desirable to include in the overall assembly. Here, successive perforated sheets 18 and 19, each approximately as wide as sheet 17, are applied in the BUR assembly. Each sheet 18 and 19 has a perforated $\frac{1}{3}$ marginal area along its entire length which, when positioned over the underlying sheet, extends beyond the edge of the preceding sheet and is in direct contact with insulation 12. Conversely, the non-perforated areas of sheets 18 and 19 are bonded to their respective underlying sheets by means of hot bitumen coatings 15(*b*) and 15(*c*). The BUR is then completed with one or more non-perforated overlaying finishing sheets; here, non-perforated sheet 20, having a width of 24 inches, is bonded to ply 19 by bonding layer 15(*d*) and is followed by non-perforated sheet 21 having a width of 12 inches which is bonded to sheet 20 by bonding layer 15(*e*). These finishing sheets provide a 3-ply membrane covering over the entire roofing area. The sheets of the above assembly interact to provide BUR of higher tensile strength per pound load.

Figure 3:
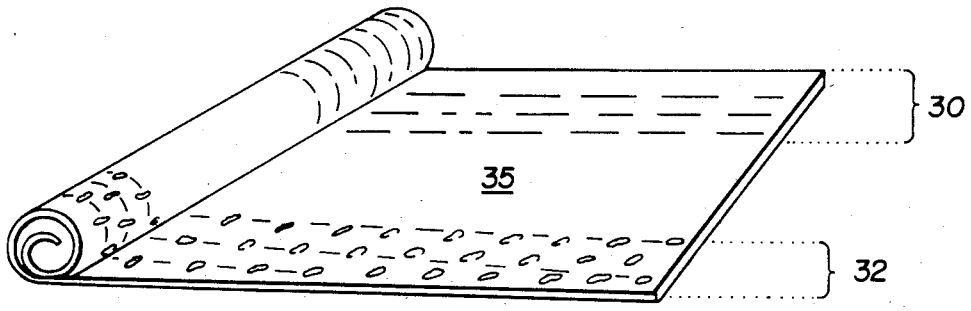

The entire finished assembly can be capped or coated with a layer of bitumen in which weather resistant mineral granules are embedded, 25. Alternatively, each of sheets 17–21 can be provided with a granulated layer on their exposed portions 27–27(*d*) so that a continuous granulated surface is laid down with the application of each ply and the need for a separate capping layer is eliminated. If desired for additional ventability, sheets 14–21 may be provided with a granulated layer on the under side of the perforated area of each ply, as shown in FIG. 3 by granulated areas 30 and 32 on ply 35.

Although shown as spheres, it is to be understood that the perforations of the present plies can be of any convenient shape, as long as they meet the dimensional requirements for adequate penetration of the asphaltic bonding vehicle.

As shown, the present invention permits each ply sheet in the assembly to be directly bonded to both the preceding ply and to the deck assembly with a minimum amount of bonding agent to provide roof membranes of reduced weight. The greatest bonding strength in the assembly is concentrated at the overlap where it is needed to overcome wind uplift and the present BUR arrangement provides a more efficient use of bonding agent without adding to the weight of the overall assembly. Also, because of the greater flexibility realized in the perforated margins of the roofing membranes, the present BUR possesses superior resistance to wide variations of temperature and weight load.

The arrangement of FIG. 2 as well as others which will become apparent from this invention and its disclosure, are responsible for the excellent properties of the present BUR assembly.

EXAMPLES 1-3

Three 5×9 foot roof assemblies consisting of a ribbed steel deck covered with mechanically attached urethane insulation boards were prepared. Each assembly was covered with a separate perforated non-granulated venting base sheet followed by three plies of fiber glass plying felt applied by hot mopping of a 1.2 mm thick layer of asphalt. The finished assemblies were then tested for wind uplift resistance, according to Factory Mutual Standard 4450.

| EXAMPLE | BASE SHEET | UPLIFT RESISTANCE |
|---|---|---|
| 1 | 3 mm thick, 1 inch holes on 5½-6 inch centers | 45 lb/ft$^2$ |
| 2 | 3 mm thick, 1 inch holes 5-6 inch centers | 45 lb/ft$^2$ |
| 3 | 0.9 mm thick, ⅜ inch holes, 3 inch centers | 105 lb/ft$^2$ |

Having thus described the invention, we claim.

What is claimed is:

1. A BUR ply comprising a felt sheet having a restricted perforated marginal along one longitudinal edge said marginal area occupying from ½ to 1/5 the width of the sheet and said perforations within said area having offset center spacing of between about 0.5 and about 5 inches and being defined by a size and shape sufficient to allow ready flow through of a bitumen or coal tar bonding agent.

2. The ply sheet of claim 1 wherein said perforations have a diameter of from about ⅛ to about ⅞ inch.

3. The ply sheet of claim 2 wherein said perforations have a diameter of from ½ to ¾ inch.

4. The ply sheet of claim 1 wherein the width of said ply sheet is between about 12 and about 48 inches.

5. The ply sheet of claim 1 wherein the ply is a felt sheet and the restricted perforated area of said sheet is composed of felt carrying a layer of weather resistant granular material on its exposed surface.

6. The ply sheet of claim 1 wherein the ply is a felt sheet and the continuous ½ to 4/5 longitudinal edge of said sheet opposite the restricted perforated area is composed of felt carrying a layer of weather resistant granular material on its exposed surface.

7. The ply sheet of claim 1 wherein the ply is a fiberglass sheet and the restricted perforated area of said sheet is composed of fiberglass carrying a layer of weather resistant granular material on its exposed surface.

8. The ply sheet of claim 1 wherein the ply is a fiberglass sheet and the continuous ½ to 4/5 longitudinal edge of said sheet opposite the restricted perforated area is composed of fiberglass carrying a layer of weather resistant granular material on its exposed surface.

9. The BUR ply of claim 1 wherein the felt sheet is asphalt impregnated.

10. A BUR system comprising:

(a) multiple roofing ply sheets each having a restricted perforated marginal area along only one longitudinal edge, said area comprising between about ½ and about 1/5 the width of the ply sheet and said area carrying from about ⅛ to about ⅞ inch diameter perforations with 0.5 to 5 inches offset center spacing and (b) an asphaltic binder layer between the ply sheets, said ply sheets having a thickness not in excess of said binder layer.

11. The BUR system of claim 10 wherein each ply sheet is a felt or a fiberglass sheet and the continuous ½ to 4/5 longitudinal edge of said sheet opposite the restricted marginal perforated area carries on its surface a layer of weather resistant granular material.

12. The BUR system of claim 11 wherein restricted marginal perforated area of each sheet carries a layer of weather resistant granular material on its reverse surface.

* * * * *